US005976022A

United States Patent [19]

Williams

[11] Patent Number: 5,976,022

[45] Date of Patent: Nov. 2, 1999

[54] COMPUTER-BASED, INTERACTIVE SPORTS TRAINING SYSTEM

[75] Inventor: Chet R. Williams, Arlington, Tex.

[73] Assignee: Raytheon Company, Lexington, Mass.

[21] Appl. No.: 08/783,399

[22] Filed: Jan. 13, 1997

[51] Int. Cl.[6] ..... A63B 69/36

[52] U.S. Cl. ..... 473/151; 473/409

[58] Field of Search ..... 473/150, 151, 473/409; 434/252

[56] References Cited

U.S. PATENT DOCUMENTS

| | | | |
|---|---|---|---|
| 3,408,750 | 11/1968 | McCollough et al. | 434/252 |
| 3,630,601 | 12/1971 | Lebovee | 473/185 |
| 4,137,566 | 1/1979 | Haas et al. | 473/209 |
| 4,163,941 | 8/1979 | Linn, Jr. | 473/222 |
| 4,304,406 | 12/1981 | Cromarty | 473/225 |
| 4,542,906 | 9/1985 | Takase et al. | 473/152 |
| 4,615,526 | 10/1986 | Yasuda et al. | 473/222 |
| 4,891,748 | 1/1990 | Mann | 473/266 |
| 5,184,295 | 2/1993 | Mann | 473/221 |
| 5,221,082 | 6/1993 | Curchod | 473/199 |
| 5,249,967 | 10/1993 | O'Leary et al. | 473/409 |
| 5,333,061 | 7/1994 | Nakashima et al. | 473/221 |
| 5,342,054 | 8/1994 | Chang et al. | 473/156 |
| 5,390,927 | 2/1995 | Angelos | 473/155 |
| 5,398,936 | 3/1995 | Kluttz et al. | 473/156 |
| 5,413,345 | 5/1995 | Nauck | 473/156 |
| 5,419,562 | 5/1995 | Cromarty | 473/409 |
| 5,437,457 | 8/1995 | Curchod | 473/199 |
| 5,486,001 | 1/1996 | Baker | 473/269 |
| 5,614,823 | 3/1997 | Katayama et al. | 473/409 |
| 5,718,639 | 2/1998 | Bouton | 473/151 |
| 5,728,006 | 3/1998 | Teitell et al. | 473/151 |
| 5,772,522 | 6/1998 | Nesbit et al. | 473/409 |
| 5,831,268 | 11/1998 | Morita et al. | 250/341.8 |

*Primary Examiner*—Jessica J. Harrison
*Attorney, Agent, or Firm*—William C. Schubert; Glenn H. Lenzen, Jr.

[57] ABSTRACT

Sensors capable of sensing the proximity of a golf club head and of generating a sensor signal in response thereto are provided. The sensors include control sensors used to communicate user commands and club-head data sensors used to analyze a golf club swing. A computer program is provided to direct a computer to analyze signals generated by the control sensors to interpret commands from a training system user. The computer also analyzes signals generated by club-head data sensors to determine the path, height, impact speed, and face impact angle of the golf club head as a function of the user commands. Analyzed club-head data sensor signals are used to calculate and graphically represent the resulting flight path of the struck golf ball with respect to a graphically simulated fairway and green presented on a video display unit. The simulated fairway and green are defined by data stored within the data storage device. The computer determines faults in the club swing, and outputs to the video display unit and a speaker appropriate recorded audio-visual responses that contain appropriate advice and demonstrations by a well-known golf professional for correcting the faults. A user can also play a simulated golf game on a simulated golf course. A calibrator is also provided to compensate for sensor misalignment.

13 Claims, 2 Drawing Sheets

COMPUTER-BASED, INTERACTIVE SPORTS TRAINING SYSTEM

TECHNICAL FIELD

This invention relates to a computerized system for analyzing a specific movement of a participant in a sport and presenting an appropriate, recorded, audio-visual lesson to explain and correct any determined problems.

BACKGROUND ART

Computers have been coupled with golf simulation devices for some time. For example, U.S. Pat. No. 4,615,526, to Yasuda et al., discloses a golf trainer including a plurality of electromagnetic sensors to detect the passage of a golf club head and calculate the head velocity, swing orbit, face angle and ball carry. The golf trainer also includes a device to display specific information calculated from the club swing.

U.S. Pat. No. 4,304,406, to Cromarty, discloses a golf training apparatus including infrared sensors that detect the passage of a golf club head between them and a source of infrared radiation. The apparatus also calculates swing parameters, displaying them alphanumerically on a television display, a graphic representation of the direction of the swing also being displayed.

U.S. Pat. No. 5,249,967, to O'Leary et al., discloses a training device using a pair of video cameras to record a student's golf club swing from behind and from the side of the student. A video overlay generator receives the live images and combines them, while in their video signal format, with a corresponding set of self-generated template images that represent, in static outline form, the dynamic technique of a master in the desired situation.

U.S. Pat. No. 5,390,927, to O'Leary et al., discloses a training device including a target screen upon which an image of a golf hole is projected. The device detects club angle and determines therefrom a resulting slice or hook and displays the ball path using a spotlight generated by a tracer.

While the prior techniques function with a certain degree of efficiency, none disclose the advantages of the improved computer-based, interactive sports training system of the present invention as is hereinafter more fully described.

DISCLOSURE OF THE INVENTION

An object of the present invention is to provide an interactive sports training system for analyzing a user's swing of a chosen golf club and presenting a chosen recorded lesson or a lesson that best explains, and suggests methods for correcting, faults detected in the swing.

Another object is to provide a method for calibrating sensing elements of the system prior to use to compensate for sensed element misalignment.

An advantage of the present invention is that the system can use a personal computer to perform analyses of input data and to determine from the analyses faults in a golf club swing and which of a set of recorded lessons would be most appropriate for presentation to correct the faults.

A feature of the present invention is that a participant can interact therewith by selecting a lesson, repeating a lesson, or progressing to a subsequent lesson.

An additional feature of the present invention is that a participant can interact therewith by selecting any golf club.

Another feature of the present invention is that a participant can interact therewith by electing to play a complete game of golf on a simulated golf course.

In realizing the aforementioned and other objects, advantages and features of the computer-based, interactive sports training system of the present invention, a plurality of sensors are provided. Each sensor is capable of sensing the proximity of a golf club head and of generating a sensor signal in response thereto.

The plurality of sensors include club-head data sensors and control sensors. Sensor signals generated by the club-head data sensors are used to determine information relating to a golf club swing. Sensor signals generated by the control sensors are used to determine user commands.

A multiplexer is connected to the sensors to receive and format sensor signals for communication to a computer such as a home computer. A data storage device, such as a compact disk read-only memory is also provided; and a computer program is stored therein. The computer program directs the computer to analyze control sensor signals and to determine thereby a training system user's club selection, lesson selection and readiness to swing the club.

The computer program also directs the computer to analyze, as a function of user commands, club-head data sensor signals received from the multiplexer during a club swing to determine, from the pattern, order and relative timing of club-head data signals, the path, height, impact speed, and face impact angle of the golf club head.

The computer program then directs the computer to determine, as a function of club-head data signals, faults in the club swing. Under direction of the computer program, the computer next outputs appropriate recorded audio-visual responses, stored in the data storage device, that contain appropriate advice for correcting the faults.

The interactive sports training system also provides a calibrator having a bar that is translated across the sensors. The differences in the times that the passing calibrator bar is detected by the sensors are stored in a calibration table for comparison with future golf club head detection times to compensate for sensor misalignment.

The objects, advantages and features of the present invention are readily apparent from the following detailed description of the best mode for carrying out the invention when taken in connection with the accompanying drawings.

BRIEF DESCRIPTION OF THE DRAWINGS

A more complete appreciation of the invention and many of the attendant advantages and features thereof may be readily obtained by reference to the following detailed description when considered with the accompanying drawings in which like reference characters indicate corresponding parts in all the views, wherein.

The objects, features and advantages of the present invention are readily apparent from the following detailed description of the best mode for carrying out the invention when taken in connection with the accompanying drawing figures.

BEST MODE FOR CARRYING OUT THE INVENTION

Figure 1:
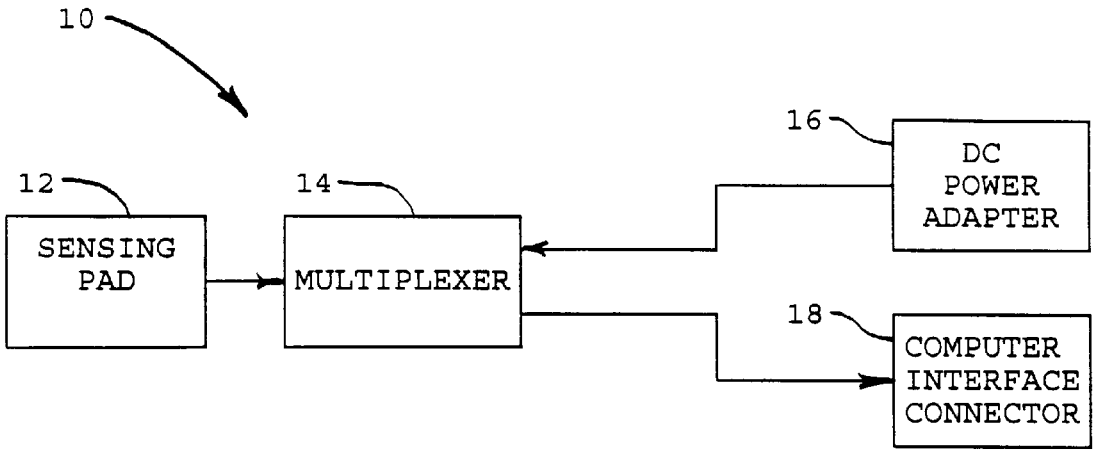
FIG. 1 is a schematic drawing showing the interconnection of elements of a preferred embodiment of the present invention.

Shown schematically by FIG. 1 of the drawings is the interconnection of elements of a preferred embodiment of an interactive sports training system, generally indicated by reference numeral 10, of the present invention. A sensing pad 12 is shown connected to a multiplexer 14. Connected to the multiplexer 14 is a DC power adapter 16 and a computer interface connector 18.

Figure 2:
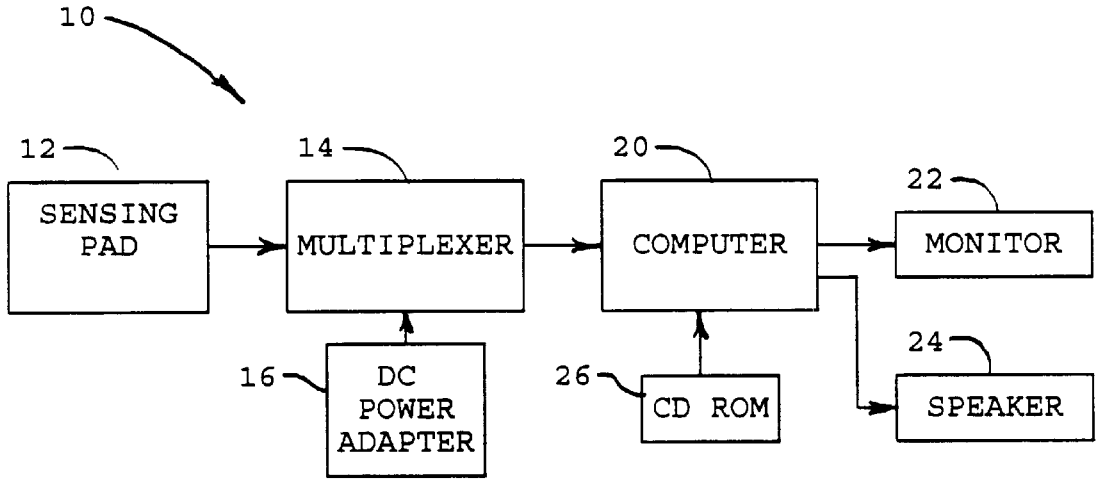
FIG. 2 is a schematic drawing showing the interconnection of the elements of FIG. 1 as connected to a typical home computer.

FIG. 2 shows the interactive sports training system 10 of FIG. 1 as it would typically be connected to a computer 20 such as a home computer. The computer interface connector 18 is preferably an RS 232 connector, or a functional equivalent thereof. As stated, it is used to connect an output of the multiplexer 14 to the computer 20. For the sake of simplifying the schematic diagram, however, the computer interface connector 18 is assumed to accomplish the stated connection to the computer 20 and is not shown in FIG. 2. Connected to the computer 20 is shown a video display unit, or computer monitor, 22 and a speaker 24 to display video information and to reproduce audio information respectively. A data storage device, such as a compact-disk read-only memory (CD ROM) 26 or its functional equivalent, is connected to the computer 20 to store a computer program and audio-visual responses.

Figure 3:
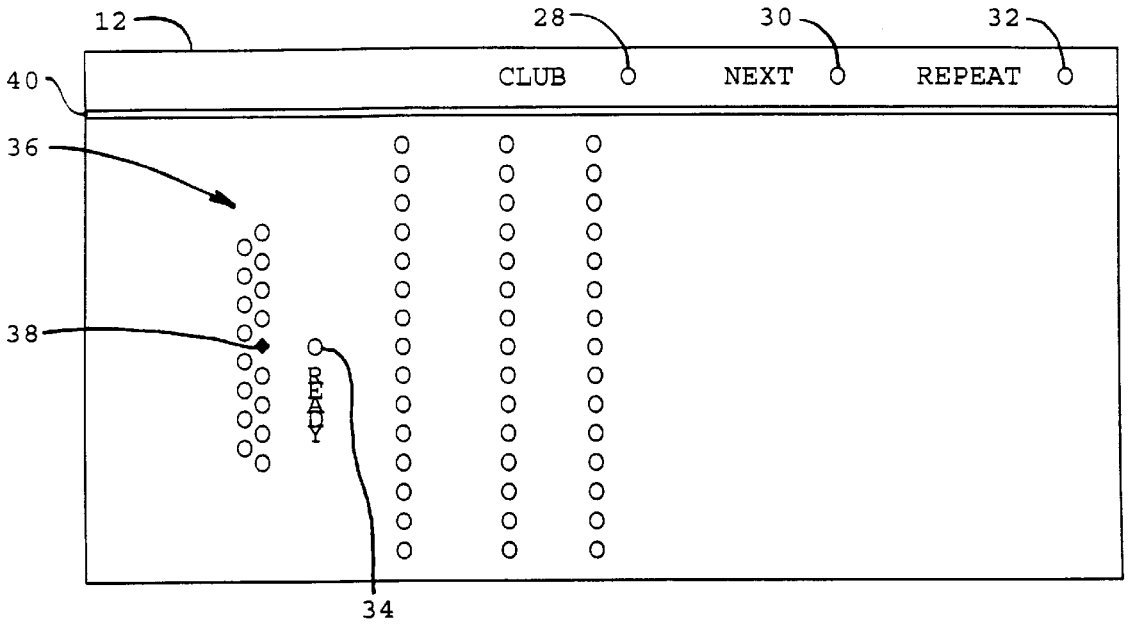
FIG. 3 is a drawing representing the layout of a sensing pad, shown schematically in FIGS. 1 and 2, of the present invention.

FIG. 3 shows details of the sensing pad 12, which is formed of a resilient material, for example, rubber or a functional equivalent thereof. The dimensions of the sensing pad are typically 0.5 inch in thickness, 1 foot in width and 2 feet in length. Attached to, and preferably embedded in, the sensing pad 12 are a plurality of control sensors, namely, a CLUB sensor 28, a NEXT sensor 30, a REPEAT sensor 32 and a READY sensor 34. The remaining sensors are all club-head data sensors, generally indicated by reference numeral 36. A strike target 38 indicates the point at which a golf club head is swung and preferably represents an actual golf ball. If an actual ball is used, a ball catching net (not shown), or its functional equivalent, is used to catch the ball after being struck by a golf club.

Figure 4:
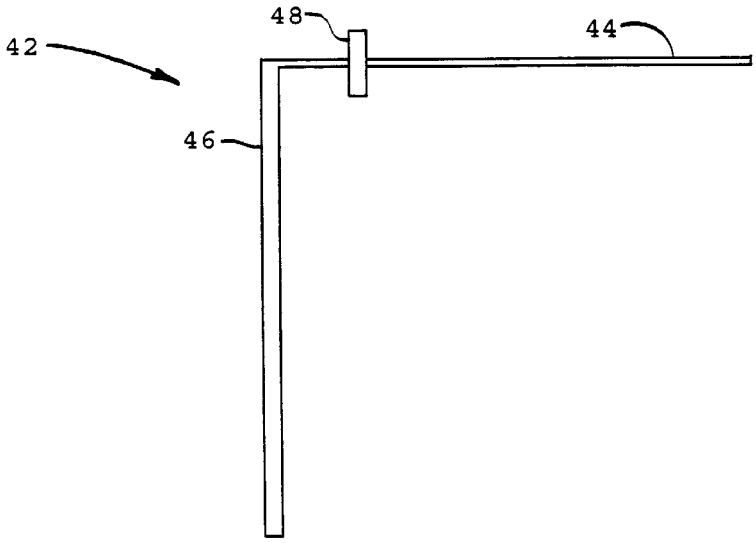
FIG. 4 shows a calibrator for use in calibrating elements of the sensing pad of FIG. 3.

As shown by FIGS. 3 and 4, a calibrator guide slot is disposed along the length of the sensing pad 12. A calibrator, generally indicated by reference numeral 42 (FIG. 4), includes a calibrator guide bar 44, which is slidable within the calibrator guide slot 40, a calibrator bar 46, which is translated across the club-head data sensors 36 while being maintained in lateral alignment by the calibrator guide bar 44, from which it extends at right angles. A calibrator handle 48 is attached to the calibrator guide bar 44 to facilitate manual operation of the calibrator 42.

In FIG. 3, the club-head data sensors 36 are shown in a representative configuration (not to scale). They are disposed generally in a matrix configuration in a prestrike area of the sensing pad 12 and in a relatively dense cluster proximate the strike target 38. Although the sensors are categorized according to the applications of their output sensor signals, as control sensors 28, 30, 32 and 34 and club-head data sensors 36, they are preferably all matched, infrared, integrated emitter-detector pairs capable of sensing the proximity of a golf club head and of generating a sensor signal in response thereto. Such sensors typically operate in the 940 nanometer wavelength range and at speeds in the nanosecond range.

Sensor signals generated by the control sensors 28, 30, 32 and 34 are used to determine a sport training system user's commands. Sensor signals generated by the club-head data sensors 36 are used to determine information relating to a golf club swing. The multiplexer 14 receives the generated sensor signals and, using a well-known logic circuit, formats them for communication to the computer 20.

When power is first applied to the training system 10, it is automatically set to calibration mode, and menus for subsequent operation appear on the computer monitor 22. Prior to a training operation, a training system user pushes the calibrator handle 48 and slides the calibrator bar 46 across the club-head data sensors 36 at a relatively constant speed. As each club-head data sensor 36 is proximately overpassed by the calibrator bar 46, it generates a club-head data sensor signal. The differences in the times at which these club-head data sensor signals are generated are stored in a calibration table for comparison with future golf club head detection times to compensate for sensor misalignment.

A training operation is typically initiated when a training system user selects a golf club for use during a training lesson. By moving the club head across the face of the CLUB sensor 28 in response to a menu displayed on the computer monitor 22, the user indicates the club chosen. By moving the club head across the face of the NEXT sensor 30 in response to the menu, the user indicates the next lesson chosen. By placing the club head above the READY sensor 34, the user indicates a readiness to begin. By placing the club head above the REPEAT sensor 32, the user indicates a desire to repeat the previous lesson.

The computer program directs the computer 20 to analyze the signals generated by the control sensors to determine the training system user's choices and readiness. If the user has chosen to view a lesson before swinging, the computer 20 outputs to the computer monitor 22 and speaker 24 an appropriate recorded audio-visual response, stored in the data storage device 26, that contains instructions and a demonstration of a particular activity. The user then swings the chosen club at the impact target, or golf ball, 38. The club-head data sensors 36 over which the club head passes generate club-head data sensor signals.

Each club-head data sensor signal has a time value assigned to it. When the club head passes across the first set of club-head data sensors, the first signal generated serves as a "starting point." Time intervals, or deltas, are measured from the starting point time to the time when other club-head data sensor signals are generated as the club head continues along its swing path.

The computer program directs the computer 20 to analyze, as a function of user commands and calibration table data, the signals generated by the club-head data sensors 36 to determine, from the pattern, order and relative timing of club-head data signals, the path, height, impact speed, and face impact angle of the golf club head and also the right-handedness or left-handedness of the user. This information is then used by the computer 20 to calculate and graphically represent club-head swing data and/or the resulting flight path of the struck golf ball 38 with respect to a graphically simulated fairway and green presented on the computer monitor 22. The simulated fairway and green are defined by data stored within the data storage device 26.

The computer program then directs the computer 20 to determine, as a function of the club-head data, any faults in the club swing. Under direction of the computer program, the computer 20 next outputs appropriate recorded audio-visual responses, stored in the data storage device 26, that contain appropriate advice for correcting determined faults. Such responses preferably include audio-visual presentations of a well-known golf professional, who explains and demonstrates detected faults and effective corrections therefore.

As commanded by the training system user, the computer program can also direct the computer 20 to display on the computer monitor 22 a simulated golf course upon which a simulated golf game can be played. The simulated golf course is defined by data stored within the data storage device 26.

It should be understood that the principles of the present invention could be applied to a computer-based, interactive sports training system that uses a computer program to select recorded lessons to correct and/or demonstrate the swing of a baseball bat, a tennis racket or the like when appropriately sensed signals representing the swing is analyzed by a computer.

While the best mode for carrying out the invention has been described in detail, those familiar with the art to which this invention relates will recognize various alternative designs and embodiments for practicing the invention as defined by the following claims.

What is claimed is:

1. A computer-based, interactive sports training system, comprising:

a plurality of sensors, each sensor being capable of sensing the proximity of a golf club head and of generating a sensor signal in response thereto wherein the sensors include a sensor for identifying a club selected by a user;

a multiplexer connected to the sensors to format sensor signals received therefrom for communication to a computer; and a computer program for directing the computer to analyze, as a function of a training system user's prior club selection, lesson selection and readiness indication, sensor signals received from the multiplexer during a golf club swing to identify faults therein and to select and output to a video display unit and at least one speaker recorded audio-visual responses that contain appropriate information for correcting the faults.

2. The training system as defined by claim 1, wherein each of the plurality of sensors includes a matched, infrared, integrated emitter-detector pair.

3. The training system as defined by claim 2, wherein the plurality of sensors are supported by a resilient pad.

4. The training system as defined by claim 1, wherein the plurality of sensors include control sensors and club-head data sensors.

5. A computer-based, interactive sports training system, comprising:

a plurality of sensors, each sensor being capable of sensing proximity of a golf club head and of generating a sensor signal in response thereto, wherein the sensors include a club sensor, a next sensor and a ready sensor;

a multiplexer connected to the sensors to format sensor signals for communication to a computer; and a computer program for directing the computer to analyze, at least as a function of a training system user's club selection, lesson selection and readiness indication, sensor signals received from the multiplexer during a golf club swing to identify faults therein and to select and output to a video display unit and at least one speaker recorded audio-visual responses that contain appropriate information for correcting the faults.

6. The training system as defined by claim 5, wherein the computer program contains instructions to direct the computer to operate according to club, lesson and ready commands selected by a user of the training system by positioning the golf club head proximate an appropriate control sensor.

7. The training system as defined by claim 6, wherein the computer program contains instructions to direct the computer to determine, from the pattern, order and relative timing of club-head data signals, the path, height, impact speed, and face impact angle of the golf club head and the right-handedness or left-handedness of the user.

8. The training system as defined by claim 7, wherein the video display unit is a computer monitor.

9. The training system as defined by claim 8, further including a data storage device, the computer program being stored within the data storage device, and further including instructions to direct the computer to display, on the computer monitor, a simulated flight path of a golf ball struck by the golf club head, the flight path being within a displayed environment defined by data also stored within the data storage device.

10. The training system as defined by claim 9, wherein the data storage device includes a compact disk read-only memory.

11. The training system as defined by claim 10, wherein the computer program further includes instructions to direct the computer to display, on the video display unit, a simulated golf course upon which a simulated golf game can be played by a user of the training system, the simulated golf course being defined by data stored within the data storage device.

12. The training system as defined by claim 10, wherein the plurality of sensors are disposed in a plane, the training system further including a calibrator bar guidably translatable across the plane of the club-head data sensors, differences in the times that the passing calibrator bar is detected by the sensors being stored in a calibration table for comparison with future golf club head detection times to compensate for sensor misalignment.

13. A method for training a golfing student using a computer-based, interactive sports training system, the method including the following steps:

identifying a selected golf club using a club sensor which detects proximity of the golf club prior to a swing thereof;

sensing the proximity of a golf club head during a swing thereof;

multiplexing sensor signals generated by the sensors in response to the passage of the golf club head and communicating formatted signals to a computer;

directing the computer to analyze, as a function of a training system user's prior club selection, lesson selection and readiness indication, sensor signals received from the multiplexer during a golf club swing to identify faults therein; and selecting and outputting, to a video display unit and at least one speaker, recorded audio-visual responses that contain appropriate information for correcting the faults.

* * * * *